US005947194A

United States Patent [19]

Baek et al.

[11] Patent Number: 5,947,194

[45] **Date of Patent: *Sep. 7, 1999**

[54] HEAT EXCHANGER FINS OF AN AIR CONDITIONER

[75] Inventors: Youn Baek, Suwon; Young-Saeng Kim, Inchun, both of Rep. of Korea

[73] Assignee: Samsung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/895,834

[22] Filed: Jul. 17, 1997

[30] Foreign Application Priority Data

Aug. 23, 1996 [KR] Rep. of Korea ..... 96-35073

[51] Int. Cl.[6] ..... F28D 1/04

[52] U.S. Cl. ..... 165/151; 165/181

[58] Field of Search ..... 165/151, 181

[56] References Cited

U.S. PATENT DOCUMENTS

| | | | |
|---|---|---|---|
| 4,550,776 | 11/1985 | Lu | 165/151 |
| 5,042,576 | 8/1991 | Broadbent | 165/151 |
| 5,056,594 | 10/1991 | Kraay | 165/151 |
| 5,660,230 | 8/1997 | Obosu et al. | 165/151 |
| 5,685,367 | 11/1997 | Jun | 165/151 |
| 5,727,625 | 3/1998 | Youn et al. | 165/151 |

FOREIGN PATENT DOCUMENTS

| | | | |
|---|---|---|---|
| 0155193 | 12/1980 | Japan | 165/151 |
| 0162134 | 8/1985 | Japan | 165/151 |
| 0194293 | 10/1985 | Japan | 165/151 |
| 62-266391 | 11/1987 | Japan | 165/151 |
| 136692 | 5/1992 | Japan | 165/151 |
| 1017246 | 1/1966 | United Kingdom | 165/151 |

*Primary Examiner*—Christopher Atkinson

*Attorney, Agent, or Firm*—Burns, Doane, Swecker & Mathis, L.L.P.

[57] ABSTRACT

A heat exchanger includes parallel flat fins spaced apart to conduct an air current therebetween. Heat transfer pipes for conducting refrigerant pass perpendicularly through the fins in a zigzag pattern. Each fin includes grilles in the form of slits which are oriented generally radially relative to respective heat transfer pipes for disturbing the air current passing around the outer peripheries of the pipes. Ridges are formed in each fin in front of and behind each pipe to increase the heat transfer area to increase the heat transfer area of the fin and strengthen the fin against bending forces.

1 Claim, 4 Drawing Sheets

HEAT EXCHANGER FINS OF AN AIR CONDITIONER

BACKGROUND OF THE INVENTION

1. Field of the Invention

The present invention relates to a heat exchanger of an air conditioner, and more particularly to a heat exchanger of an air conditioner in which slit type grilles are formed in a flat fin.

2. Description of the Prior Art

A heat exchanger of an air conditioner according to the prior art includes, as illustrated in FIG. 1, a plurality of flat fins 1 provided in parallel at a predetermined spacing, and a heat transfer pipe 2 arranged perpendicular to the plurality of flat fins 1 and provided in zigzag style. The air current moves among the plurality of flat fins 1 in a direction represented by an arrow to perform a heat exchange with fluid in the heat transfer pipe 2.

Furthermore, as regards heat fluid characteristics around the plurality of flat fins, a temperature boundary layer 3 on a heat transfer surface of the flat fins 1 becomes, as depicted in FIG. 2, thicker in proportion to the square root of a distance from an entry end of the air current. Thus, there is a disadvantage in that a heat transfer rate between the air current and fins is remarkably decreased as the distance from the entry end of the air current increases, and thereby decreases the heat transfer efficiency of the heat exchanger.

There is still another disadvantage when air current of low speed moves past the heat transfer pipes 2, in that a cavitation zone 4 is generated at a rear area of each heat transfer pipe 2 (i.e., the area cross hatched in FIG. 3), so that a heat transfer rate is remarkably decreased at the cavitation zone 4 to thereby cause a drop in heat transfer performance of the heat exchanger.

As a prior art to deal with the aforementioned disadvantages, Japanese Laid/Open Uutility Model Application No. Sho. 55-110995 is disclosed, where the fins of an air conditioner are, as illustrated in FIG. 4, formed with a plurality of bent slit units 5*a*, 5*b*, 5*c*, 5*d*, 5*e* and 5*f* disposed in a gap formed between the heat transfer pipes 2.

In other words, the slit units 5*a*, 5*c* and 5*e* as illustrated in FIG. 5, caused to protrude from one surface of the flat fins 1 by a cutting and bending process, with the slit units arranged at a predetermined interval, and the other slit units 5*b*, 5*d* and 5*f* protrude from the opposite surface of the flat fins 1 and are arranged between the slit units 5*a*, 5*c* and 5*e*.

The flat fins 1 formed with the plurality of slit units 5*a*, 5*b*, 5*c*, 5*d*, 5*e* and 5*f* can expect a high heat transfer performance compared with flat fins having no slit units. The slit units 5*a* and 5*b* at an upper stream side of the flat fins 1 provide a high heat transfer performance because a thin temperature boundary layer is formed thereat. However, the heat transfer performance becomes lower at the downstream slit units 5*c*, 5*d*, 5*e* and 5*f* because the slit units 5*c*, 5*d*, 5*e* and 5*f* are disposed in the temperature boundary layer formed by the slit units 5*a* and 5*b*.

There is another problem in that a cavitation zone where the air current does not flow is generated at a rear side of the heat transfer pipe 2, thereby reducing heat transfer efficiency.

There is still another problem in that the fin has a limited heat transfer area and is relatively easily bendable.

SUMMARY OF THE INVENTION

The present invention is presented to solve the aforementioned problems and it is an object of the present invention to provide a heat exchanger of an air conditioner by which air current flowing through the plurality of flat fins is turbulently mixed to increase a heat transfer efficiency for enhanced heat transmission performance, and at the same time to effectively reduce a cavitation zone generating at a rear side of the heat transfer pipe.

It is another object of the present invention to provide a heat exchanger fin having an increased part to thereby broaden a heat transfer area and to increase a strength thereof, so that a bending phenomenon of the flat fin can be minimized.

These and other objects are achieved by the present invention which relates to a heat exchanger adapted for use in an air conditioner. The heat exchanger comprises a plurality of flat fins arranged in parallel at a predetermined spacing, to conduct an air current between adjacent fins. Heat transfer pipes extend perpendicularly through the fins in a zigzag pattern to allow the air current to flow past the heat transfer pipes. A plurality of grilles is formed in each fin. Each grille comprises slit parts oriented at an angle relative to a direction of flow of the air current and arranged generally radially relative to respective heat transfer pipes. The slit parts are spaced from the heat transfer pipes to disturb the air current flowing around outer surface of the heat transfer pipes. Pairs of first and second bead parts are formed in, and project from, a surface of each fin. The first and second bead parts are located respectively in front of and behind a respective heat transfer pipe to increase a heat transfer area of the fin and strengthen the fin against bending forces.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
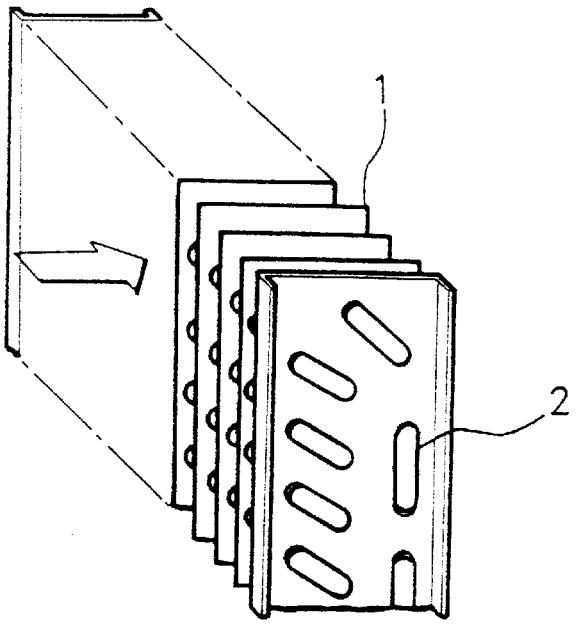
FIG. 1 (PRIOR ART)
FIG. 1 is a perspective view of a heat exchanger according to the prior art.
Figure 2:
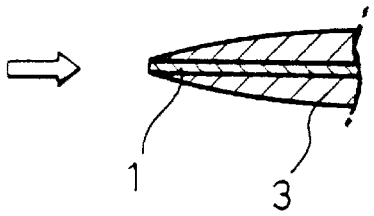
FIG. 2 (PRIOR ART)
FIG. 2 is an enlarged view for illustrating a thermal fluid characteristic around a flat fin in FIG. 1.

There follows a detailed description of a preferred embodiment of a heat exchanger fin of an air conditioner according to the present invention and with reference to the accompanying drawings.

Throughout the drawings, like reference numerals and symbols are used for designation of like or equivalent parts or portions as in FIGS. 1 through 5 will be omitted for simplicity of illustration and explanation and redundant description.

Figure 6:
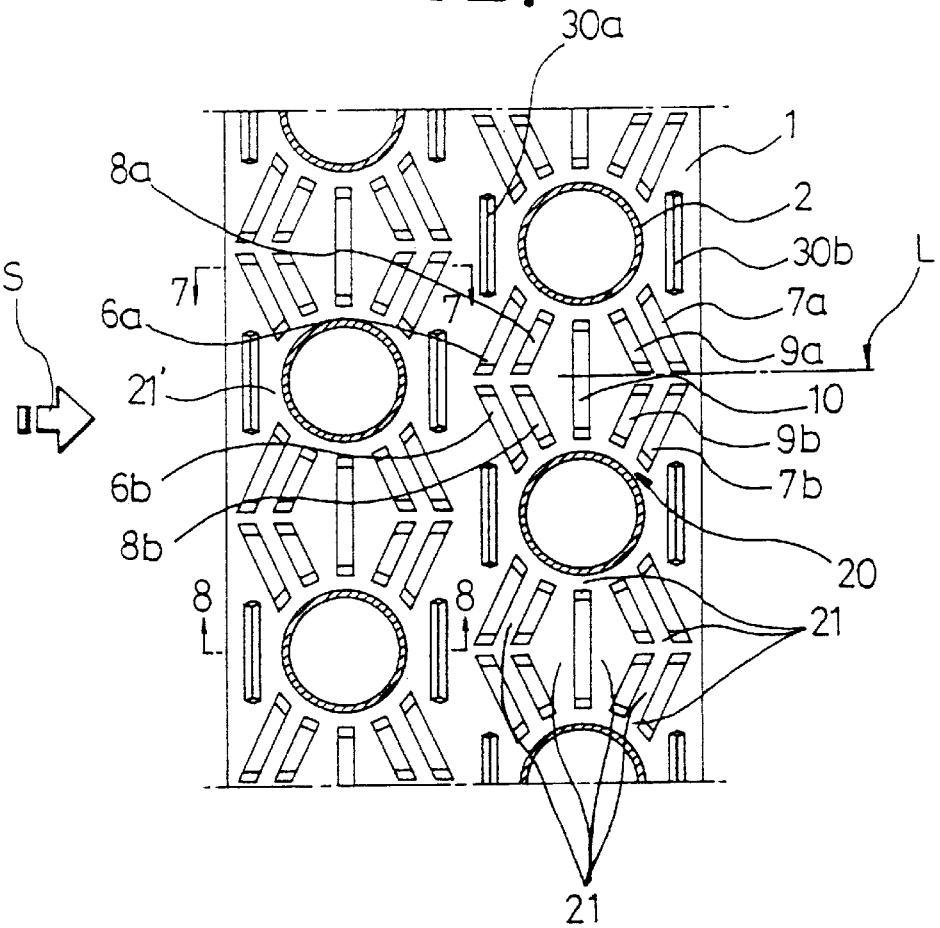
FIG. 6 is a plan view illustrating a flat fin of a heat exchanger according to the present invention.

The heat exchanger of an air conditioner according to the present invention includes, as illustrated in FIG. 6, a plurality of flat fins 1 arranged in parallel at a predetermined interval to allow air current to flow therebetween, and heat transfer pipes 2 passing perpendicularly through the fins 1 in a zigzag pattern to allow the air current to flow therepast. Each fin includes a plurality of slit type grilles 20, each grille comprising first and second slit parts 6*a* and 6*b*, third and fourth slit parts 7*a* and 7*b*, fifth and sixth slit parts 8*a* and 8*b*, seventh and eighth slit parts 9*a* and 9*b*, and a ninth slit part 10. The slit parts of respective grilles 20 are opened at a predetermined angle toward the incoming air current and are arranged above and below respective heat transfer pipes 2 at a predetermined spacing therefrom. The air current flowing along each surface of the fin is disturbed by the grilles. The slit parts extend radially with respect to the associated pipe 2. First and second bead parts 30*a* and 30*b* are symmetrically formed in the fin at a predetermined interval upstream and downstream, respectively, of the heat transfer pipes 2 so as to broaden the heat transfer area of the flat fin 1 and increase the strength of the fin 1.

Figure 3:
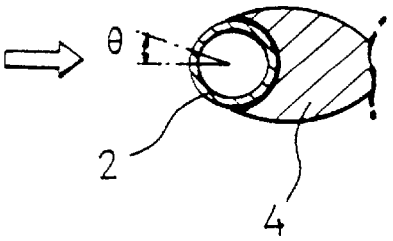
FIG. 3 (PRIOR ART)
FIG. 3 is an enlarged view for illustrating a thermal fluid characteristic around a heat transfer pipe in FIG. 1.
Figure 4:
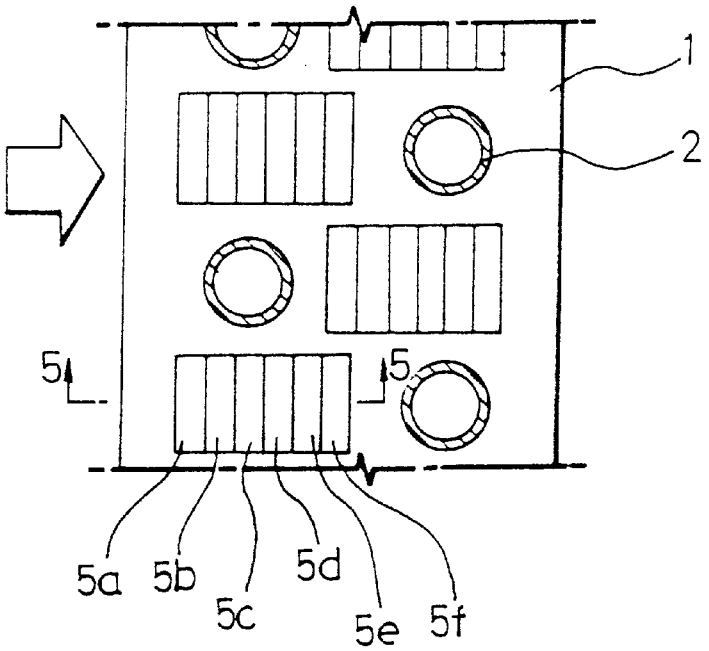
FIG. 4 (PRIOR ART)
FIG. 4 is a plan view of a flat fin of another heat exchanger according to the prior art.
Figure 5:
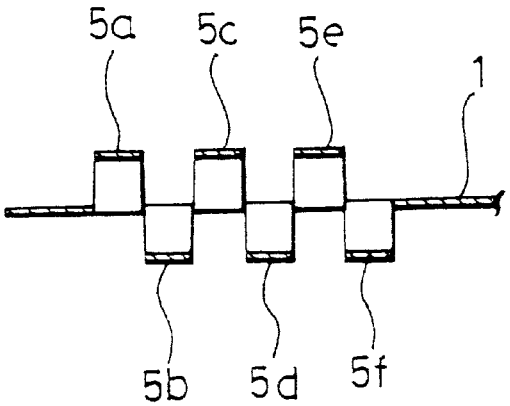
FIG. 5 (PRIOR ART)
FIG. 5 is a sectional view taken along line 5—5 in FIG. 4.

Each grille 20 shown in FIG. 3 is disposed between an upper pipe 2 and a lower pipe 2. The first and second slit parts 6*a* and 6*b* project from a first side 40 of the fin. The first and second slit parts are symmetrically formed at an upstream end of the respective grille 20 and extend at an angle to one another and at a common angle relative to a center line L passing through the grille 20. Air current encountering a lower front side of the upper pipe 2 is disturbed by the upper slit part 6*a*, and air encountering an upper front side of the lower pipe 2 is disturbed by the second slit part 6*b*, the disturbed air becoming turbulent.

The third and fourth slit parts 7*a* and 7*b* project from the first side 40 of the fin. The slit parts 7*a* and 7*b* are symmetrically formed at a downstream end of the respective grille 20 and extend at an angle to one another and at a common angle relative to the center line L. Turbulent air leaving a lower rear side of the upper pipe is disturbed by the slit part 7*a*, and turbulent air leaving the upper rear side of the lower pipe 2 is disturbed by the slit part 7*b*.

The fifth and sixth slit parts 8*a* and 8*b* are symmetrically formed at a location downstream of the first and second slit parts, respectively but project from the second side 40' of the fin (i.e. a side opposite the side from which the first and second slit parts project. The fifth and sixth slit parts extend at an angle relative to one another and at a common angle relative to the center line L. Air approaching a lower front side of the upper pipe 2 is disturbed by the fifth slit part 8*a*, and air approaching an upper front side of the lower pipe 2 is disturbed by the sixth slit part 8*b*.

The seventh and eighth slit parts 9*a* and 9*b* are symmetrically formed at a location upstream of the third and fourth slit parts, respectively; but project from the second side 40'. The seventh and eighth slit parts extend at an angle relative to one another and extend at a common angle relative to the center line L. Turbulent air leaving a lower rear side of the upper pipe is disturbed by the slit part 9*a*, and turbulent air leaving the upper rear side of the lower pipe 2 is disturbed by the slit part 9*b*.

The ninth slit part 10 projects from the second side 40' of the fin at a location between the fifth and sixth slit parts 8*a* and 8*b* on the one hand, and the seventh and eighth slit parts 9*a* and 9*b* on the other hand. Turbulent air passing around the lowermost part of the upper pipe 2 is disturbed by an upper portion of the ninth slit part 10, and air passing around the uppermost part of the lower pipe 2 is disturbed by a lower portion of the ninth slit part 10.

The first and second slit parts 6*a* and 6*b* are spaced apart by a segment 21 of the fin, and the same is true of the other three pairs of slit parts. All of those segments 21 are of equal width.

The area defined by the each of the first to fourth slit parts is larger than the area defined by the fifth to eighth slit parts, because of a variance in length of the slit parts; the widths of the first to eighth slit parts are the same, however.

Each of the slit parts is formed by forming a partial cut-out in the fin and then bending the partial cut out.

The first, third, fifth, and seventh slit parts 6*a*, 7*a*, 8*a*, and 9*a* project generally radially toward the upper pipe 2, and are spaced from the upper pipe by equal distances. The same is true of the second, fourth, sixth and eighth slit parts 6*b*, 7*b*, 8*b* and 9*b* with reference to the lower pipe 2.

Figure 8:
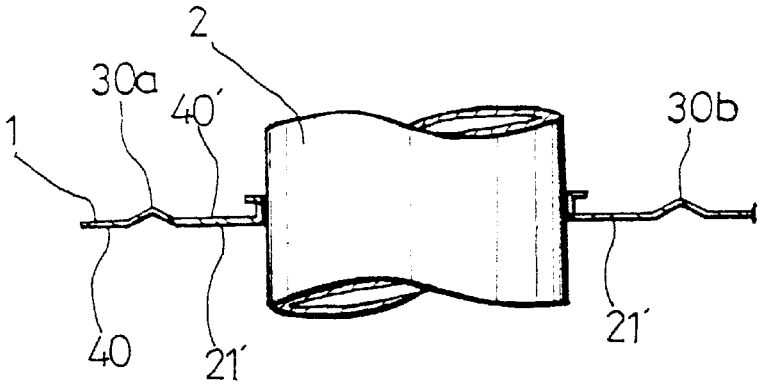
FIG. 8 is a sectional view taken along line 8—8 in FIG. 6.
Figure 9:
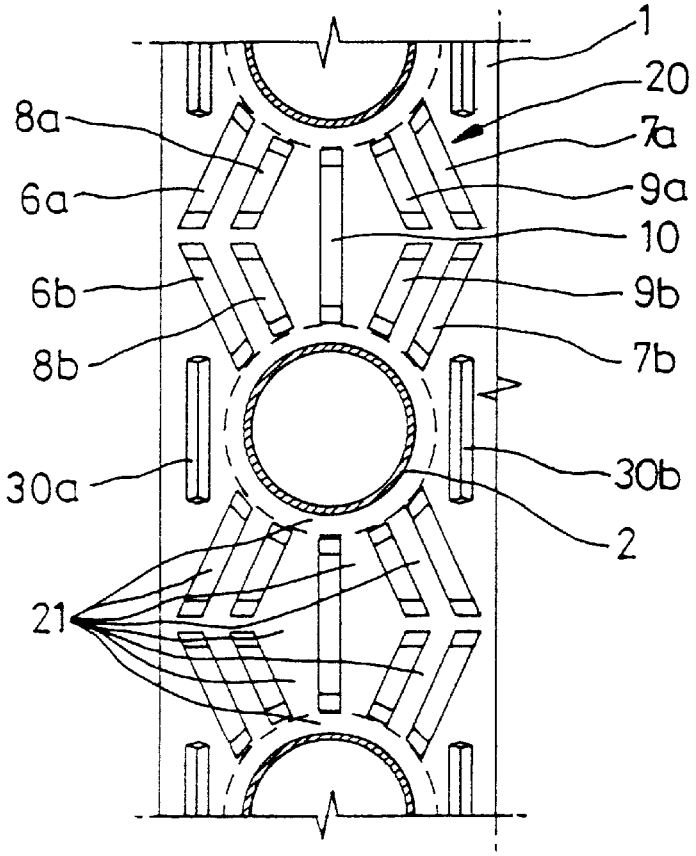
FIG. 9 is a an enlarged plan view of a fragment of FIG. 6.

The pairs of first and second bead parts 30*a* and 30*b* are configured as V-shaped ridges that protrude from the second side 40' of the fin and arranged such that the first bead part 30*a* is situated in front of a respective pipe 2, and the second bead part is situated behind the pipe. The bead parts 30*a*, 30*b* are spaced from the pipe by segments 21' of the fin which are of equal width (see FIG. 8). The first bead part extends perpendicular to the direction of air flow (see FIG. 9), and overlaps a lower end of the first slit part 6*a* and an upper end of the second bead part 6*b*, as seen by the approaching air.

Next, the operation of the heat exchanger fins of an air conditioner according to the embodiment of the present invention thus constructed will be described.

Figure 7:
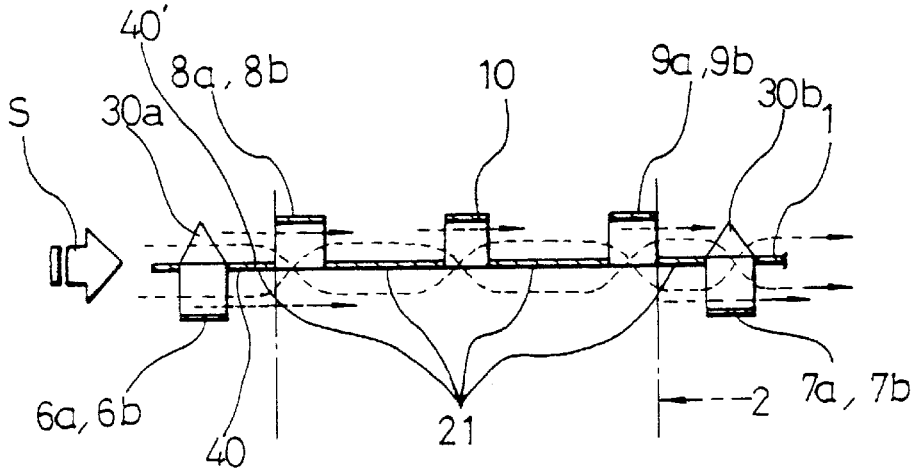
FIG. 7 is a sectional view taken along line 7—7 in FIG. 6.

When the air current flows between the fins 1 in the direction of an arrow (S) illustrated in FIG. 7, it becomes turbulent while it passes through the first, second, third, fourth, fifth, sixth, seventh and eighth slit parts 6*a*, 6*b*, 7*a*, 7*b*, 8*a*, 8*b*, 9*a* and 9*b*.

The flowing air current simultaneously passes through the ninth slit part 10 and is divided thereby into two flows which thereafter join together for creating a mixed air current.

By becoming turbulent, the air current effectively reduces the cavitation zone at the rear side of each heat transfer pipe 2 and increases the heat transfer efficiency at that rear side.

In other words, the first, second, third and fourth slit parts 6*a*, 6*b*, 7*a* and 7*b* protrude from the first surface 40 of the flat fin 1, whereas the fifth, sixth, seventh, eighth and ninth slit parts 8*a*, 8*b*, 9*a*, 9*b* and 10 protrude from the second surface of the flat fin 1, so that the slit parts 6*a*, 6*b*, 7*a* and 7*b* are not included in a temperature boundary layer formed by the slit parts 8*a*, 8*b*, 9*a*, 9*b* and 10 in the flowing direction of the air current to thereby provide a heat transfer efficiency.

Since the slit parts 6*a*, 6*b*, 7*a*, 7*b*, 8*a*, 8*b*, 9*a*, 9*b* and 10 are spaced by equal distances from the respective heat transfer pipe 2, and are radially arranged with respect to the pipes, the flowing air current can be disturbed by the grilles and can be dispersed along a peripheral area of the heat transfer pipes 2 to thereby reduce cavitation zones at the rear sides of the heat transfer pipes 2.

The slit parts also serve to increase heat transfer efficiency at the rear of the heat transfer pipes 2, and to expedite a flow of the heat toward the heat transfer pipes 2.

Meanwhile, the first and second bead parts 30*a* and 30*b*, lying in front of and behind the heat transfer pipes 2, serve to strengthen the fin against being bent and increase the total heat transfer area of the fin.

As is apparent from the foregoing, there is an advantage resulting from plurality of slit parts radially formed around the periphery of heat transfer pipes and opened toward oncoming air current and protruding from first and second surfaces of the flat fin at predetermined angles, in that those slit parts serve to strongly mix the moving air current and make the air current turbulent to effectively decrease the cavitation zones generating at the backs of the heat transfer pipes and to further increase heat transfer efficiency.

There is another advantage in that the rate of heat transfer at each of the heat transfer pipes is expedited.

There is still another advantage in that heat transfer efficiency among the plurality of heat transfer pipes is further increased.

There is still a further advantage resulting from the bead parts in that a heat transfer area and bending strength of the flat fin are increased flat fin.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A heat exchanger adapted for use in an air conditioner, the heat exchanger comprising:

a plurality of flat fins arranged in parallel at a predetermined spacing, to conduct an air current therebetween from upstream edges of the fins to downstream edges thereof, each fin including first and second sides;

heat transfer pipes extending through the fins in a zigzag pattern to allow the air current to flow past the heat transfer pipes;

a plurality of grilles formed in each fin, each grille comprising slit parts oriented at an angle relative to a direction of flow of the air current and arranged generally radially relative to respective heat transfer pipes to disturb the air current flowing around outer surfaces of the heat transfer pipes; and pairs of first and second bead parts formed in a linear shape and projecting from one of the surfaces of each fin, the first and second bead parts located respectively in front of and behind a respective heat transfer pipe and spaced by equal distances from the heat transfer pipe to increase a heat transfer area of the fin and strengthen the fin against bending forces, wherein each grille includes:

first and second slit parts projecting symmetrically from the first side of the fin at an upstream end of the grille and extending at an angle to one another and at a common angle relative to a center line passing through the grille in a downstream direction, third and fourth slit parts projecting symmetrically from the first side of the fin at a downstream end of the grille and extending at an angle to one another and at a common angle relative to the center line;

fifth and sixth slit parts projecting symmetrically from the second side of the fin at a location downstream of the first and second slit parts and extending at an angle to one another and at a common angle relative to the center line;

seventh and eighth slit parts projecting symmetrically from the second side of the fin downstream of the fifth and sixth slit parts and upstream of the third and fourth slit parts, the seventh and eighth slit parts extending at an angle to one another and at a common angle relative to the center line; and a ninth slit part projecting from the second side of the fin downstream of the fifth and sixth slit parts and upstream of the seventh and eighth slit parts.

* * * * *